US006196632B1

(12) United States Patent
De Lucchi et al.

(10) Patent No.: US 6,196,632 B1
(45) Date of Patent: Mar. 6, 2001

(54) CHAIR, ESPECIALLY AN OFFICE CHAIR

(75) Inventors: Michele De Lucchi, Milan (IT); Gerhard E. Reichert, Meersburg (DE)

(73) Assignee: Mauser Office GmbH, Korbach (DE)

( * ) Notice: Subject to any disclaimer, the term of this patent is extended or adjusted under 35 U.S.C. 154(b) by 0 days.

(21) Appl. No.: 09/420,111

(22) Filed: Oct. 18, 1999

(30) Foreign Application Priority Data

Oct. 17, 1998 (DE) ..... 198 47 961

(51) Int. Cl.[7] ..... A47C 1/12

(52) U.S. Cl. ..... 297/451.1; 297/411.4; 297/301.1

(58) Field of Search ..... 297/445.1, 452.2, 297/452.31, 452.36, 286, 301.1, 451.1, 411.4, 411.41, 300.2, 452.29, 354.1, 354.12

(56) References Cited

U.S. PATENT DOCUMENTS

D. 21,503 * 4/1892 Ward .
D. 349,196 * 8/1994 Lohmeyer .
D. 358,502 * 5/1995 Gioacchini .
D. 366,159 * 1/1996 Sagol .
2,030,635 2/1936 Horwitt .
2,986,203 * 5/1961 Close .
3,361,472 * 1/1968 Hasbrouck .
5,018,789 5/1991 Sheckells .
5,810,438 * 9/1998 Newhouse .

FOREIGN PATENT DOCUMENTS 1 654 358 3/1971 (DE) .
28 04 403 8/1979 (DE) .
92 05 008 4/1992 (DE) .
0 835 619 4/1998 (EP) .
1 040 903 10/1953 (FR) .
867 457 12/1958 (GB) .
1 348 062 3/1974 (GB) .

* cited by examiner

*Primary Examiner*—Milton Nelson, Jr.
(74) *Attorney, Agent, or Firm*—Herbert Dubno

(57) ABSTRACT

A chair, especially an office chair in which a one-piece backrest has forwardly extending arms engaging and secured to armrest portions of a tubular frame. The arms form the armrests for the chair.

10 Claims, 6 Drawing Sheets

CHAIR, ESPECIALLY AN OFFICE CHAIR

FIELD OF THE INVENTION

Our present invention relates to a chair, especially an office chair, of the type having a tubular frame, a seat and a backrest.

OBJECTS OF THE INVENTION

Chairs and especially office chairs, utilizing a tubular metal frame can be provided in a variety of configurations, for example, as a rotary chair in which the seat and backrest can pivot relative to the supporting portion of the frame, a four-legged chair or as a free-swinging chair in which the seat portion is cantilevered over the base. In all of these types of chairs, the tubular frame can comprise a pair of frame members having horizontal tubular portions which support or form the armrests. The tubular armrest portions are usually not themselves particularly comfortable and frequently a wider support for the arms of the user may be required and can be connected, e.g. by screws, to the horizontal tube portions. Of course separately mounting armrests on these tubular portions has the drawback that additional fabrication and mounting steps are required and hence the fabrication costs may be comparatively high. Also, in many cases the appearance of the chair suffers from the need to individually and separately mount armrests on these tubular frame portions.

OBJECTS OF THE INVENTION

It is, therefore, the principal object of the present invention to provide an improved chair, especially an office chair which is fabricated more easily and less expensively, is of particularly esthetic appearance and affords high stability and seating comfort, especially with respect to the armrests thereof.

Another object is to provide an office chair which can be fabricated in any of a variety of configurations, especially as a swivel chair, a four-legged chair and a free-swinging chair, whereby drawbacks of earlier chair configurations are avoided.

SUMMARY OF THE INVENTION

These objects and others which will become apparent hereinafter are attained, in accordance with the invention in a chair in which the backrest is formed as one piece with a pair of arms capable of forming armrests and fixed to the horizontal tube portions of the frame. Since the armrests are arms projecting from the one-piece backrest structure, assembly of separate parts can be avoided and unesthetic constrictions in which the armrest must be separately mounted on tubular portions of the frame, can likewise be excluded.

More particularly, the office chair of the invention comprises:

- a seat;
- a tubular chair frame supporting the seat and having a pair of bent tubular support members having generally horizontal armrest support portions spaced above the seat; and
- a one-piece backrest carried by the frame and formed unitarily with a pair of arms fitting over the respective armrest support portions and at least partly forming armrests for the chair.

A particularly esthetic and convenient construction has the arms extending the full lengths of the tubular armrest support portions, i.e. to the front of these portions. Advantageously, the arms are connected to the backrests by transition portions which widen toward the backrest and away from the free ends of the arms. The widening from the free end cross section can be provided only at the rear of each arm or can be gradual from portions of the arm relatively close to the free ends. The fastening of the arms to the tubular portions can be effected in a variety of ways. For example the arms may themselves be tubular in cross section and can be fitted over the tubular portions and secured thereto, for example, by an adhesive.

It is also possible to provide the arms so that they in cross section are angular, preferably L-shaped in cross section, receiving the tubular portions between the shanks or flanges and connected to the tubular portions by screws.

The one-piece construction of the backrest and arms allows the fabrication of a wide variety of chairs with respect to the construction of the backrest, arms and frame systems a variety of connection systems between them. The arms can, for example, project from a formation extending around the back and the tubular portions may be connected by a stirrup shape member which reaches around the backrest. If desired, a back support can be attached to the extensions of the arms reaching around the back of the chair and forming the backrest in the sense of the invention.

According to another feature of the invention, the backrest can have an upper portion lying above an imaginary line through the backrest at bottom edges of said arms and a lower portion below said imaginary line. The upper and lower portions can be trapezoidal and mirror symmetrical. The backrest can, alternatively, lie wholly above a line connecting bottom edges of the arms.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
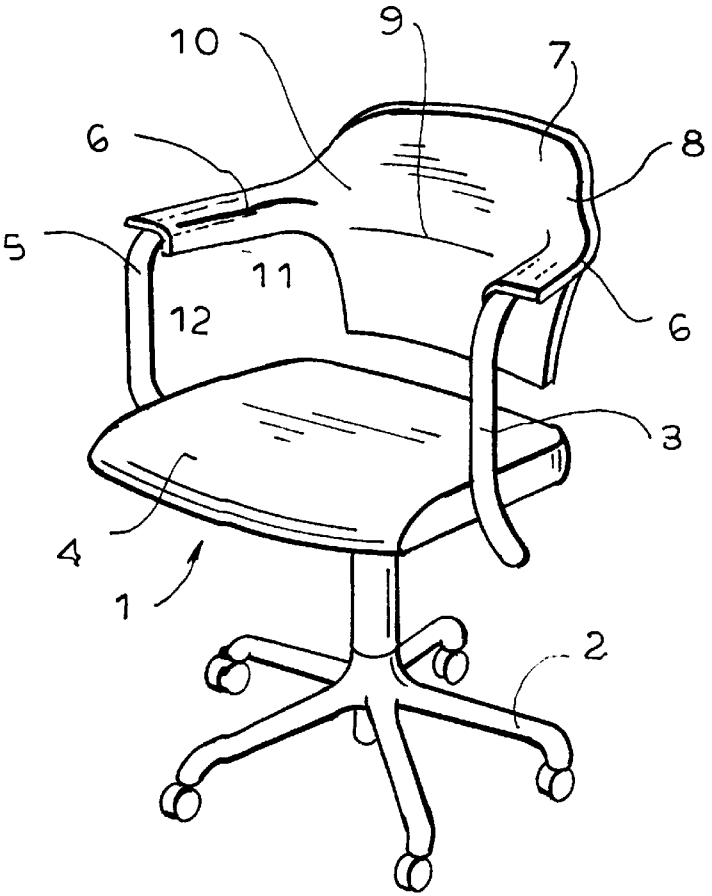
FIG. 1 is a perspective view showing a swivel-type office chair according to the invention.

The office chair 1 shown in FIG. 1 has a base 2 carrying a tubular frame 3 which has armrest support members 5 having substantially horizontal portions lying above the seat 4 and extending rearwardly in the embodiment shown here. To the horizontal portions of the tubular members 5, the arms 6 unitary with a backrest 7 are affixed.

The backrest 7, in turn, comprises an upper backrest portion 8 and a lower backrest portion 11 each of generally trapezoidal configuration and disposed above and below an imaginary line 9 connecting the bottoms of the arms 6. The arms 6 (see also FIG. 6) are angular, i.e. L-section with a horizontal upper flange and a vertical flange. Screws 12 connect the vertical flanges with the tubular portions 5. From FIGS. 1 and 6 it will also be apparent that the arms engage around the tubular portions 5 at least on their upper sides and preferably also along their inner sides. The tubular portions can be of oval cross section. While the tubular frame 3 can be composed of steel tubing, the backrest 7 and the arms 6 can be formed in one piece of wood or even of a synthetic resin. In the transition region 10 between the arms and the backrest, the arms 6 widen rearwardly and increase in cross section.

Figure 2:
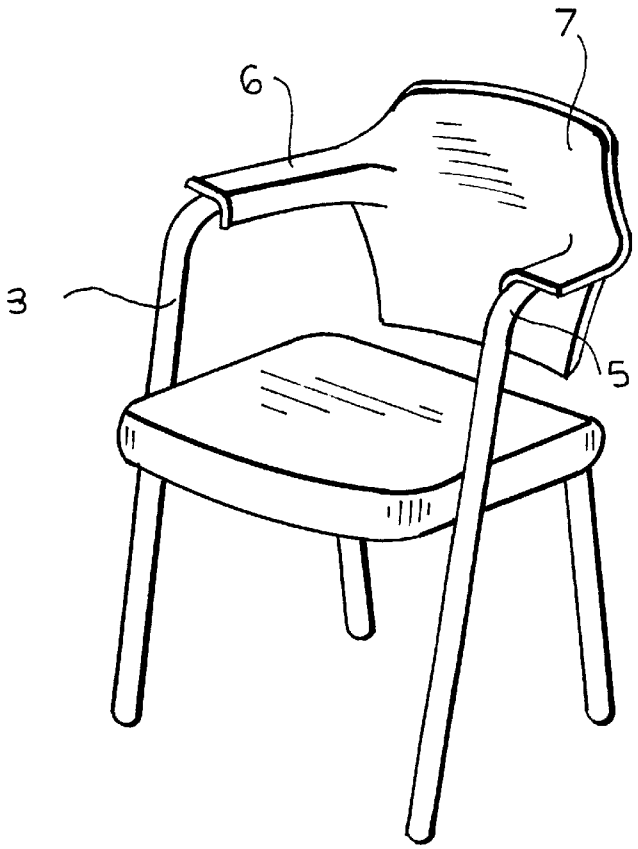
FIG. 2 is a perspective view showing a four-legged office chair embodying the invention.
Figure 3:
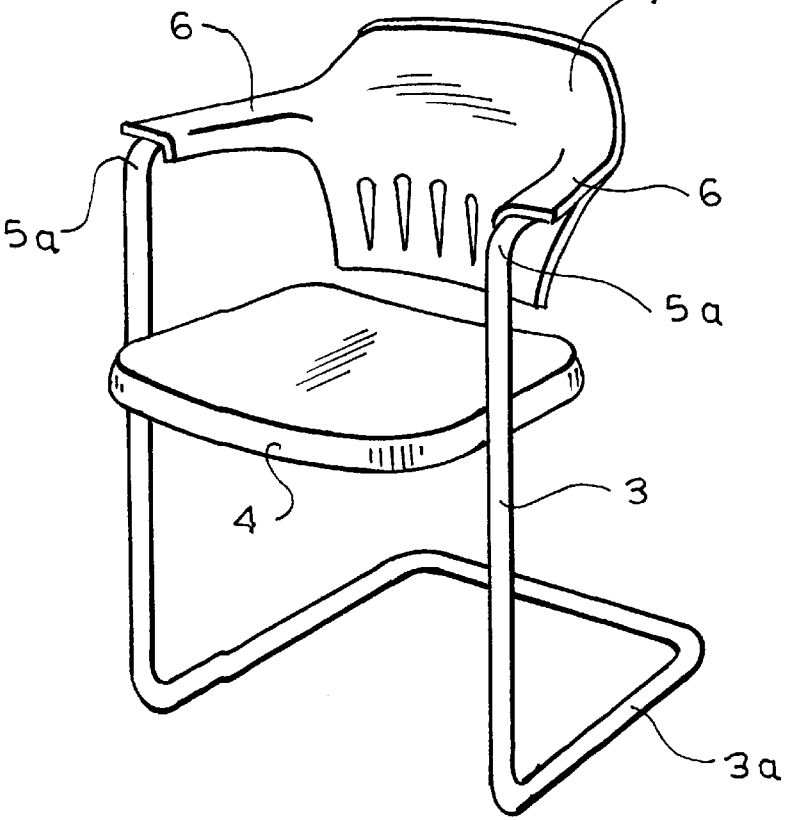
FIG. 3 is a perspective view of a free-swinging office chair.

FIG. 2 shows a four-legged chair with a backrest 7 corresponding to that of FIG. 1 and a similar backrest 7 is provided for the free swinging chair of FIG. 3 in which the backrest 7 and the seat 4 are cantilevered over the tubular base 3*a* of the frame 3.

The arms 6 of the backrest 7 can, as can be seen from FIGS. 1–3, extend forwardly practically to the bends 5*a* of the tubular portions 5 and thus cover substantially all of the horizontal portions thereof.

Figure 4:
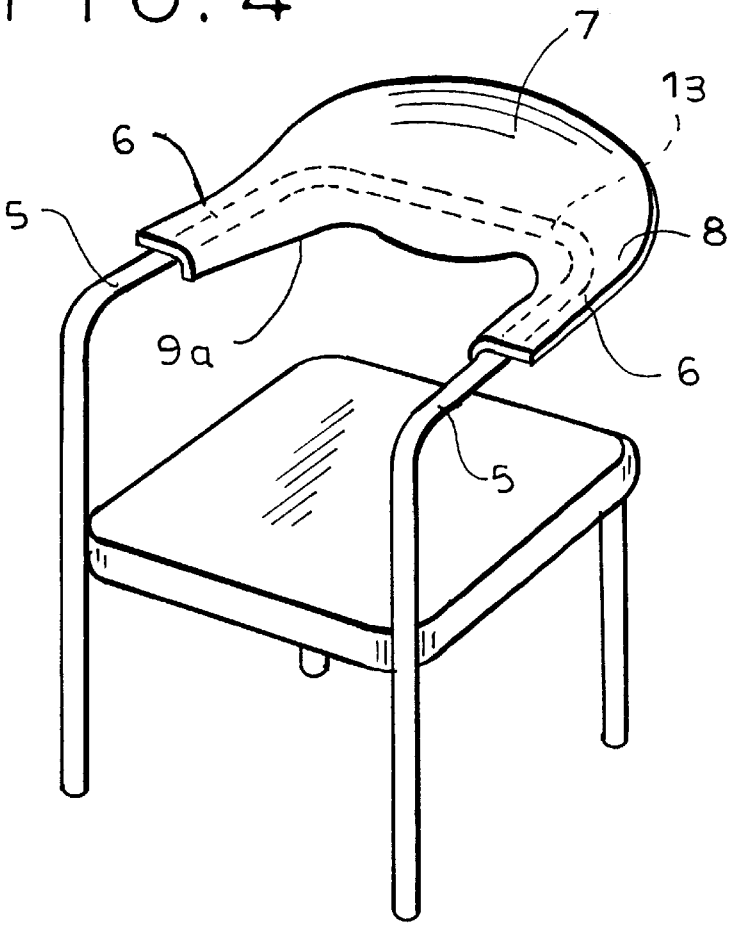
FIG. 4 is a perspective view of a four-legged chair in which the tubular frame extends around behind the backrest.

Alternatively, from FIG. 4 it will be apparent that the arms 6 can terminate short of the front ends of the tubular portions 5 and can extend only over part of the lengths thereof. FIG. 4 also shows that the tubular portions 5 can be extended into a closed tubular stirrup 13 which can engage behind the backrest 7 and can extend around the latter. In that case, it is advantageous when the backrest has only an upper portion 8 lying above the edge 9*a* defined by the bottoms of the arms 6.

Figure 5:
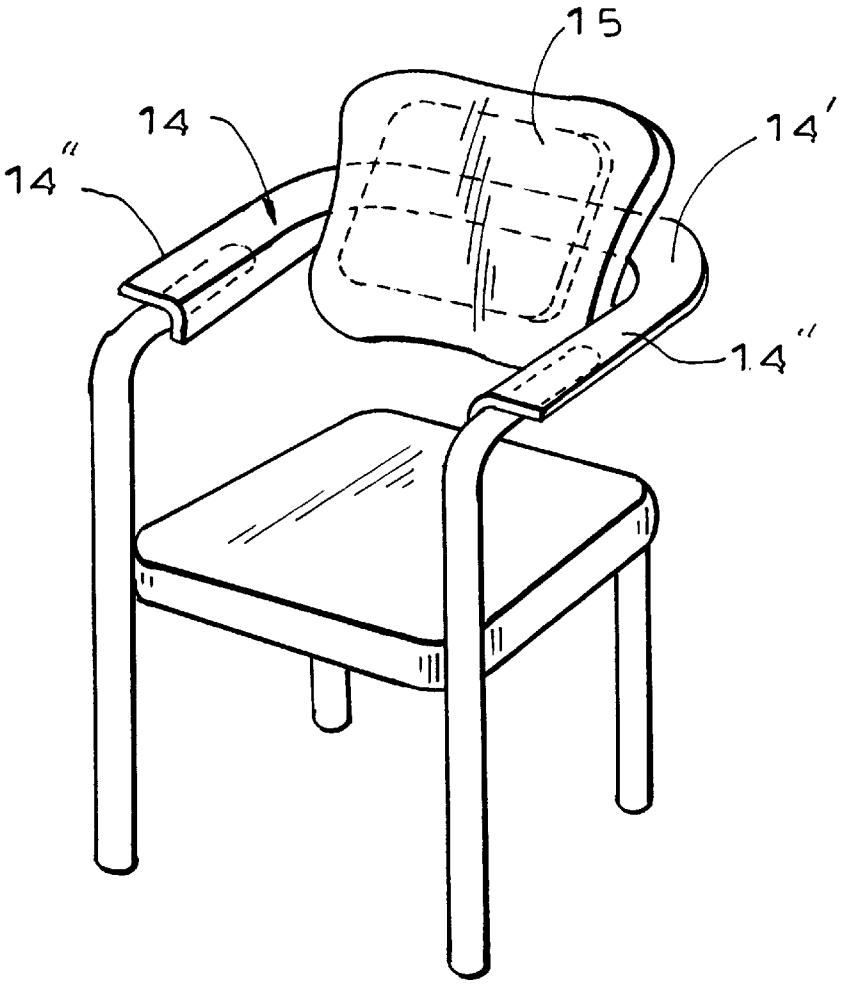
FIG. 5 is a perspective view of a chair wherein the arms form part of a stirrup shape member constituting the backrest and provided with an additional back support.
Figure 6:
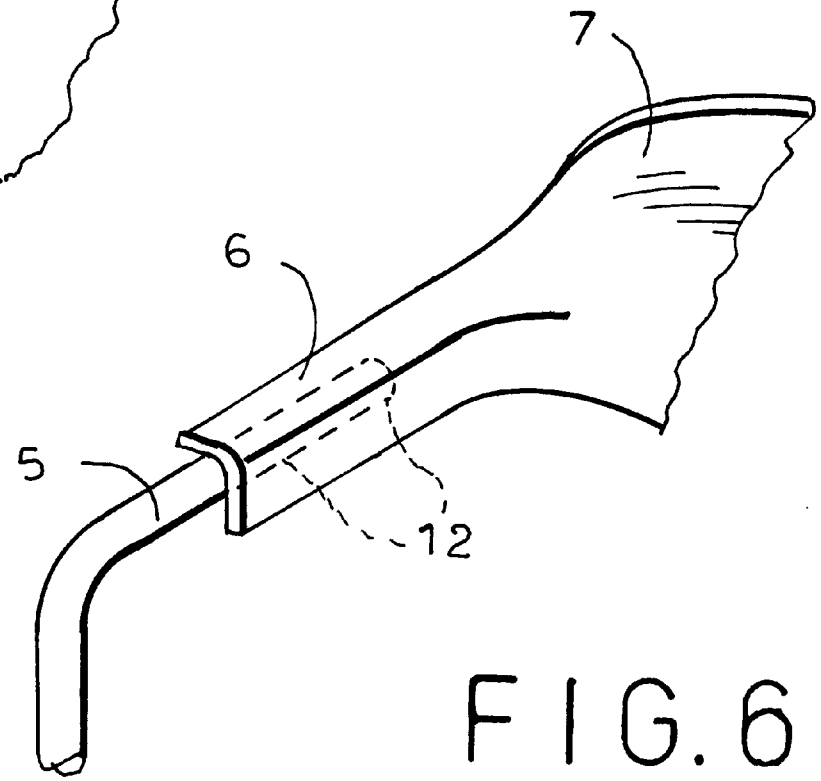
FIG. 6 is a detail in a perspective view showing one method of connecting the arms to the tubular portions.
Figure 7:
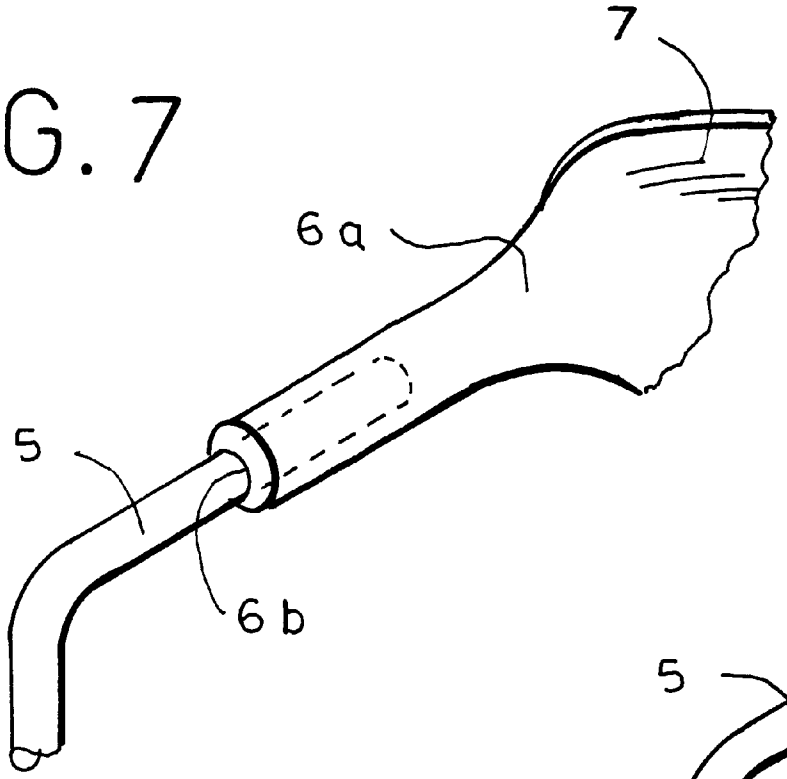
FIG. 7 is a view similar to FIG. 6 showing another connection approach.

As can be seen from FIG. 5, the arms can themselves form a stirrup extending all around the rear of the chair so that the portion 14' bridging the arms 14" can constitute the backrest and can be provided with a separate back plate 15 which can be secured to the stirrup 14. FIG. 6, as noted, shows the screws 12 passing through the arms 7 into the tubular portion 5. In the variant of FIG. 7 the arm 6*a* is tubular and fits over the tubular portion 5, a layer 6*b* of adhesive being interposed between the inner wall of the tubular arm 6*a* and the outer surface of member 5. The arm 6*a* thus forms a socket receiving the free end of the substantially horizontal rearwardly bent tubular portion 5 of the frame.

Figure 8:
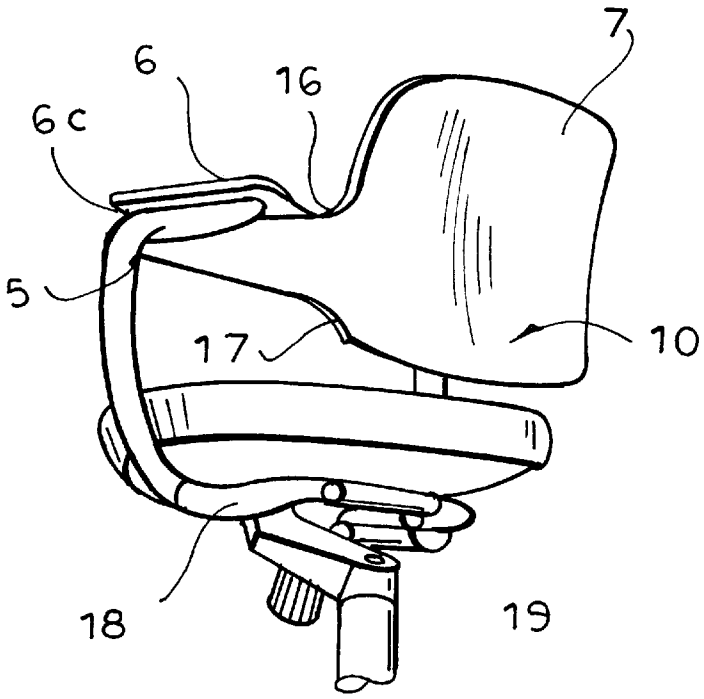
FIG. 8 is a perspective view illustrating a detail with respect to the support of the bent tube members.

From FIG. 8 it will be apparent that the transition region 10 can have upwardly and downwardly concave rounded cutouts 16 and 17 whereby the upper cutout 16 at its deepest portion lies below the substantially horizontal shank or flange 6*c* of the arm 6. In addition from FIG. 8 it will be apparent that the substantially C-shaped tubular members forming the armrest support portions 5 at their lower ends have inwardly angled pivot ends 18 directly articulated to the substantially horizontal extending journalling shaft 19 of the seat mechanism.

Figure 11:
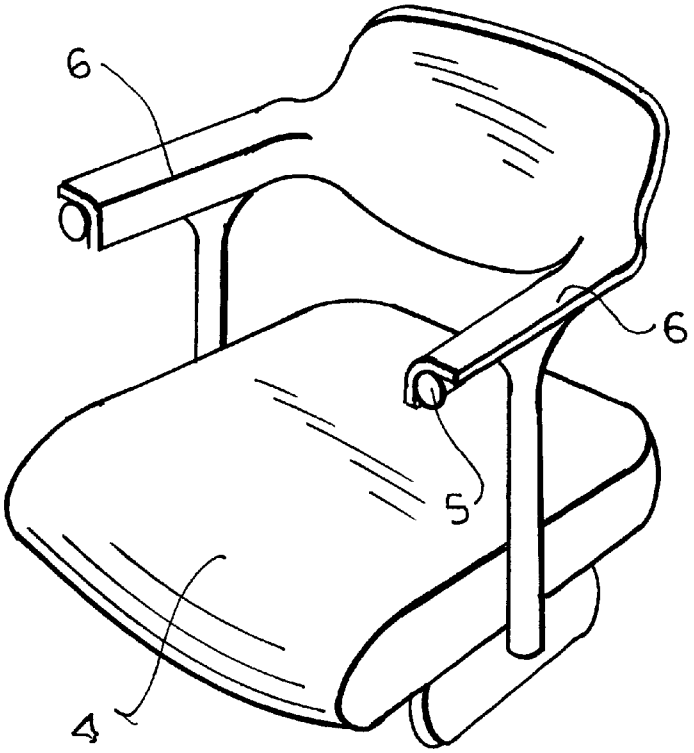
FIG. 11 is a perspective view similar to FIG. 10 showing shaped bent tube members.
Figure 9:
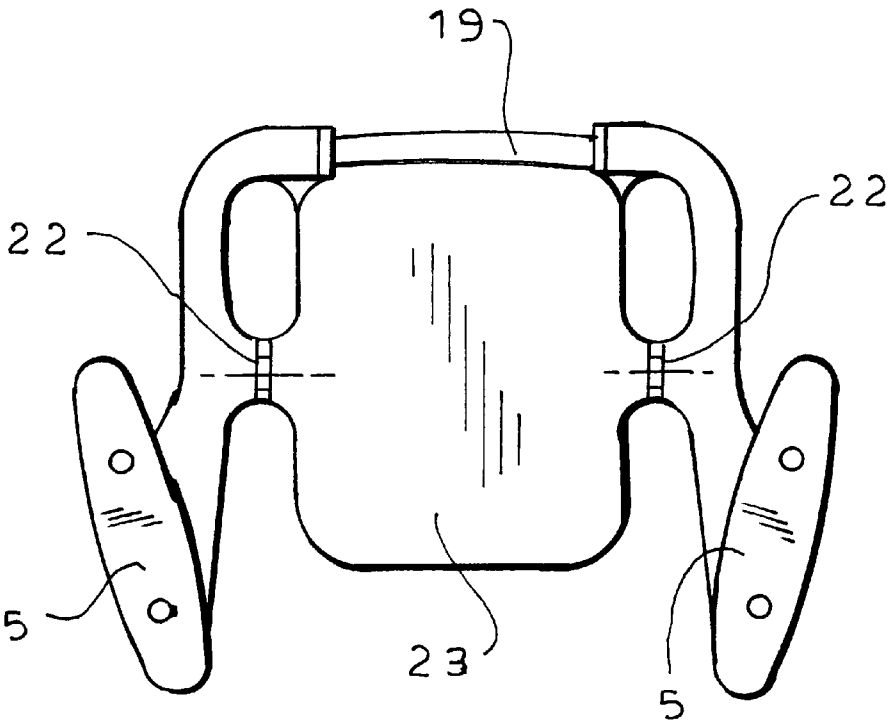
FIG. 9 is a plan view of the mounting of the bent tube members.
Figure 12:
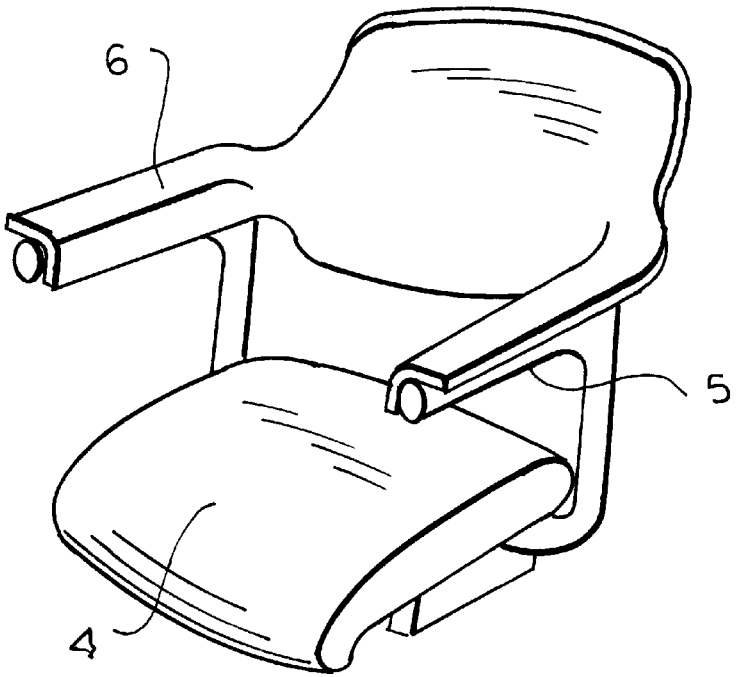
FIG. 12 is a view similar to FIGS. 10 and 11 showing L-shaped tube members.
Figure 10:
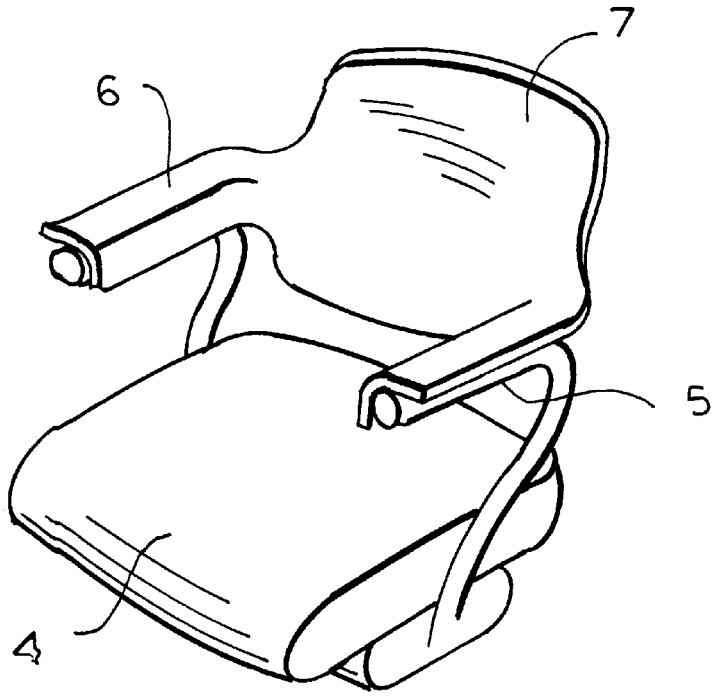
FIG. 10 is a partial perspective view of a chair with a L-shaped arrangement of the bent tube member.

The armrest bent members 5 can, as has been shown in FIG. 9, be articulated via additional journalling locations 21 on a second pivot 22 substantially parallel to the shaft 19 of the seat mechanism which has been represented generally as a synchronizing mechanism 23. Depending upon the particular mechanism chosen, the lower end of the armrest can be configured differently. The members can have C-shapes (FIG. 8), Z-shapes (FIG. 10) and T-shapes (FIG. 11) or L-shapes (FIG. 12). Of course the arms themselves can have various cross sections of which C-sections, U-sections and triangular sections are preferred. At least the upper sides, however, should be horizontal and wide enough to comfortably receive the arms of the person seated in the chair. Clips can be used to secure the arms on the armrest tubular portions if desired.

We claim:

1. A chair comprising:

a seat;

a tubular chair frame supporting said seat and having a pair of bent tubular support members having generally horizontal armrest support portions spaced above said seat; and a one-piece backrest carried by said frame and formed unitarily with a pair of arms fitting over the respective armrest support portions and at least partly forming armrests for the chair, said tubular support members having inwardly angled bearing ends directly articulated to a substantially horizontally extending pivot shaft, said tubular support members being formed with additional pivot locations at a second pivot shaft parallel to the first-mentioned pivot shaft and connected thereto by a synchronizing mechanical linkage.

2. The chair defined in claim 1 wherein said arms extend substantially over full lengths of said armrest support portions.

3. The chair defined in claim 1 wherein said armrest support portions extend rearwardly on said frame and said arms extend substantially to front regions of said armrest support portions.

4. The chair defined in claim 1, further comprising rearwardly widening transitions between said arms and said backrest.

5. The chair defined in claim 1 wherein said backrest has an upper portion lying above an imaginary line through said backrest at bottom edges of said arms, and a lower portion below said imaginary line.

6. The chair defined in claim 5 wherein said upper and lower portions are generally trapezoidal and substantially mirror symmetrical.

7. The chair defined in claim 1 wherein said arms are of angle cross section and are connected by screws with said armrest support portions.

8. The chair defined in claim 1 wherein said backrest is provided with transition regions between said arms and a back, said back having rounded cutouts adjacent said transitions.

9. The chair defined in claim 8 wherein an upwardly concave cutout adjacent each arm has a lowest point below a substantially horizontal shank of the respective arm.

10. The chair defined in claim 1 wherein said tubular support members have C-shaped configurations.

* * * * *